United States Patent [19]

Tsuzuki et al.

[11] 4,268,360

[45] May 19, 1981

[54] TEMPORARY HEAT-PROOF APPARATUS FOR USE IN REPAIRING COKE OVENS

[75] Inventors: Akira Tsuzuki, Yokohama; Hiroshi Tobitani, Kukisaki, both of Japan

[73] Assignee: Koritsu Machine Industrial Limited, Tokyo, Japan

[21] Appl. No.: 126,884

[22] Filed: Mar. 3, 1980

[51] Int. Cl.[3] ..... C10B 25/00; C10B 45/00

[52] U.S. Cl. ..... 202/270; 110/173 R; 202/248; 212/166; 220/233

[58] Field of Search ..... 202/242, 248, 269, 270; 49/34, 465; 110/173 R; 212/166; 220/233, 234, 235, 236, 237

[56] References Cited

U.S. PATENT DOCUMENTS

| | | | |
|---|---|---|---|
| 940,323 | 11/1909 | Jackson | 49/465 |
| 2,179,635 | 11/1939 | Kimmel | 202/270 |
| 2,335,866 | 12/1943 | Lavely | 202/248 |
| 2,977,106 | 3/1961 | Duff | 49/34 X |
| 3,425,733 | 2/1969 | Hollingsworth | 202/270 |
| 3,667,649 | 6/1972 | Thillet | 49/465 X |
| 4,023,372 | 5/1977 | Presler et al. | 49/34 X |
| 4,097,228 | 6/1978 | Rosling | 49/465 X |

*Primary Examiner*—Frank W. Lutter
*Assistant Examiner*—Roger F. Phillips
*Attorney, Agent, or Firm*—Wills, Green & Mueth

[57] ABSTRACT

When repairing a gate and vicinity of a coke oven chamber during operation, hot air blowing off the interior of the chamber makes repairs impossible or almost difficult. Disclosed is a temporary heat-proof apparatus capable of preventing such hot air from blowing off the chamber, which generally comprises two units in combination, viz. a heat-proof unit and a charging unit therefor. Both front end portions of the heat-proof unit are expandable toward side walls of the oven chamber, while upper and lower slide frames are arranged respectively to pressure-contact the ceiling and bottom of the chamber.

14 Claims, 8 Drawing Figures

TEMPORARY HEAT-PROOF APPARATUS FOR USE IN REPAIRING COKE OVENS

BACKGROUND OF THE INVENTION

This invention relates to a temporary heat-proof apparatus for repairs of a gate and vicinity thereof of a coke oven chamber. As well known, even when the gate and vicinity of a specific coke oven of a coking battery under operation is in need of repairs, operation of other chambers should be maintained continuously for technical, economical and other reasons. However, hot air blowing off the interior of the chamber makes repair operations very difficult. Thus, a heat-proof apparatus capable of completely preventing such inner hot air from blowing off the chamber has long been desired.

Accordingly, it is the object of this invention to provide such a heat-proof apparatus that is simple in construction, easy to operate and yet hardly damaged in use.

SUMMARY OF THE INVENTION

In accordance with the present invention, a temporary heat-proof apparatus generally comprises in combination a heat proof unit capable of completely preventing inner hot air from blowing off the chamber, and a charging unit therefor. Constructions of the heat-proof unit and charging unit will be described in greater detail hereinbelow.

DETAILED DESCRIPTION OF THE INVENTION

Figure 7:
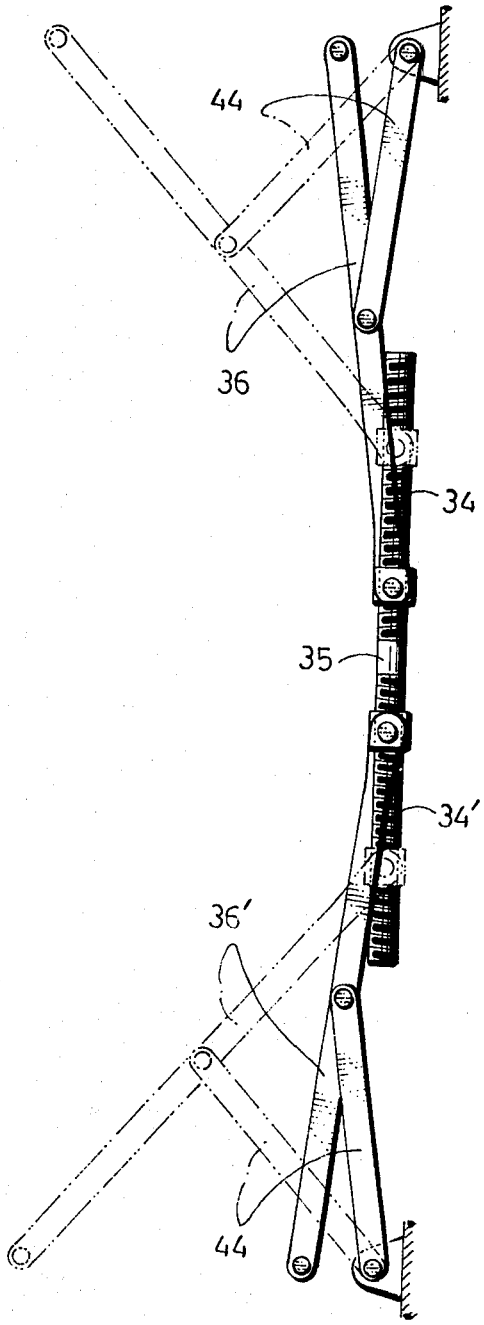
FIG. 7 is a referential view showing an example of actuation of the charging unit.
Figure 6:
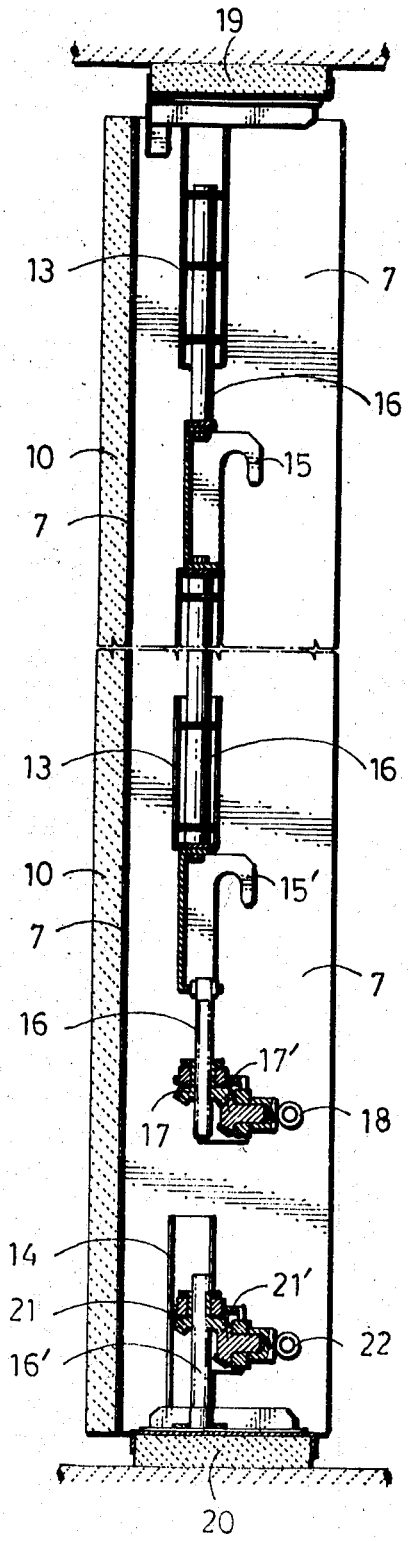
FIG. 6 is a vertical section of the structure shown in FIG. 5.
Figure 5:
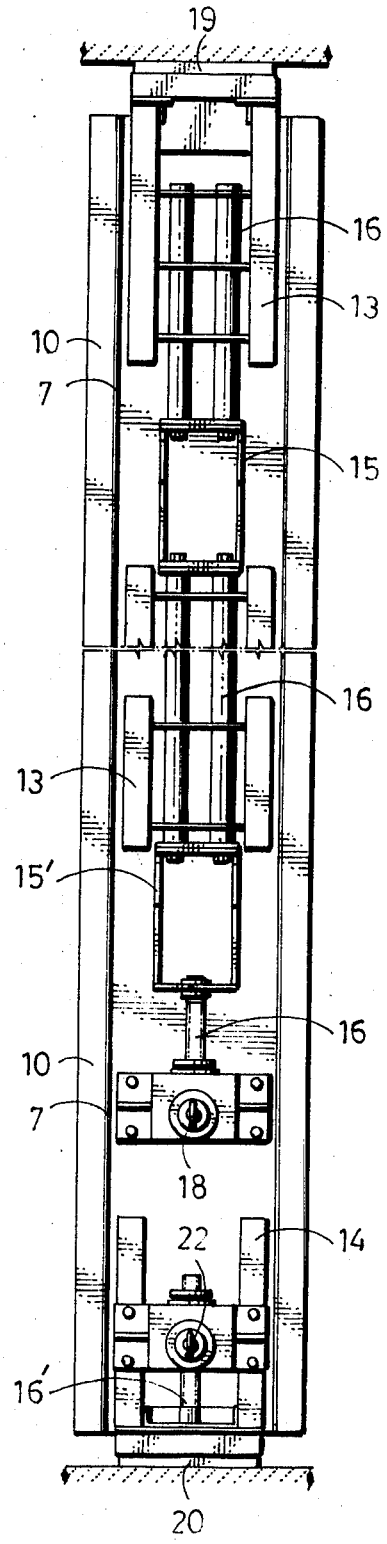
FIG. 5 is a front view of a slide frame of the heat-proof apparatus shown in FIG. 1.

Referring now to the drawings, particularly to FIGS. 1, 2A, 2B and 3, there are illustrated a pair of vertical channel members 1 and 1' substantially C-shaped in cross-section and arranged opposite each other, and a vertical backplate 2 welded at both ends to the channel members 1 and 1' to form a vertical frame 3. Onto the backplate 2 is fastened with bolts 6 a plate 5 which is provided with pairs of brackets 4 and 4' extending rearwardly therefrom. There is also illustrated a vertical heat-proof plate 7 of substantially C-shaped cross-section which is provided with pairs of brackets 8 and 8' extending forwardly for respective connection with the above-mentioned brackets 4 and 4'. The brackets 4 and 4' are joined to the corresponding brackets 8 and 8' by pins 9 inserted through fitting holes. On the outside of the heat-proof plate 7 is fitted an adiabatic member 10. Between the channels 1 and 1' are arranged upper and lower slide frames 13 and 14. As shown in FIGS. 6 and 7, the upper slide frame 13 is provided with a pair of upper and lower hooks 15 and 15' of box shape in front view and connected by vertical rods 16. On the lowermost vertical rod 16 is formed a worm-screw along which a bevel gear 17 is driven to cause the former to move up and down. The bevel gear 17 engages another bevel gear 17' which drives the former. The bevel gear 17' is fixed on one end of a gear shaft which has an eye at the other end for receiving a drive means (not shown).

On the top of the upper slide frame 13 is mounted an adiabatic member 19 for pressure-contacting the ceiling of the coke oven, and on the lower end of the lower slide frame 14 is mounted an adiabatic member 20 for pressure-contacting the bottom of the coke oven. On the vertical rod 16' is also formed a worm-screw along which a bevel gear 21 is driven to cause the vertical rod 16' to move up and down. The bevel gear 21 engages another bevel gear 21' which drives the former. The bevel gear 21' is also fixed on one end of a gear shaft (not identified) intersecting the rod 16' at right angles. The other end of the gear shaft is provided with an eye 22 to insert a drive means thereinto for driving the bevel gear.

Figure 1:
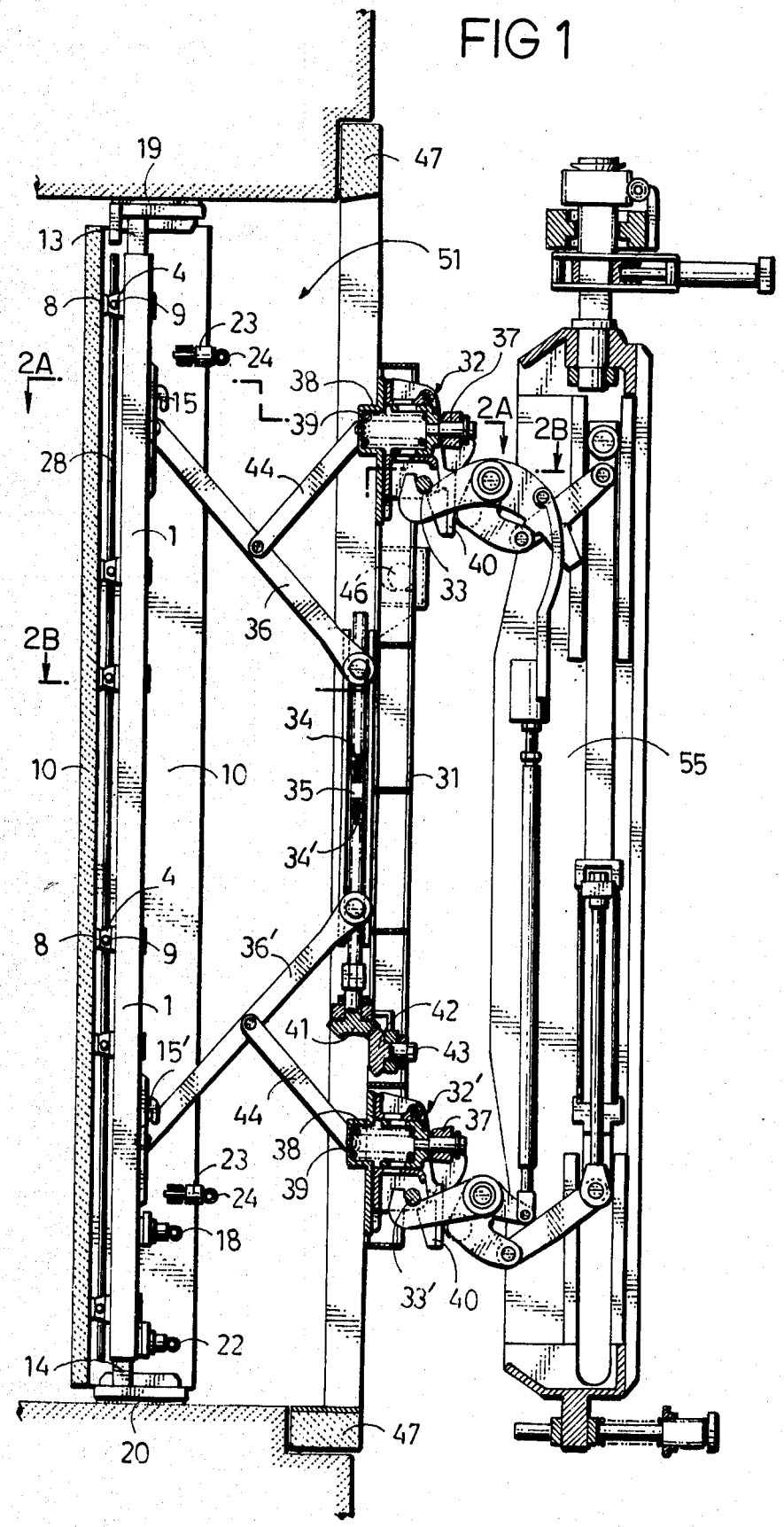
FIG. 1 is a vertical sectional view of a temporary heat-proof apparatus constructed in accordance with the invention, shown in combination with a charging unit and a door lifter apparatus and inserted into a coke oven chamber.
Figure 2A:
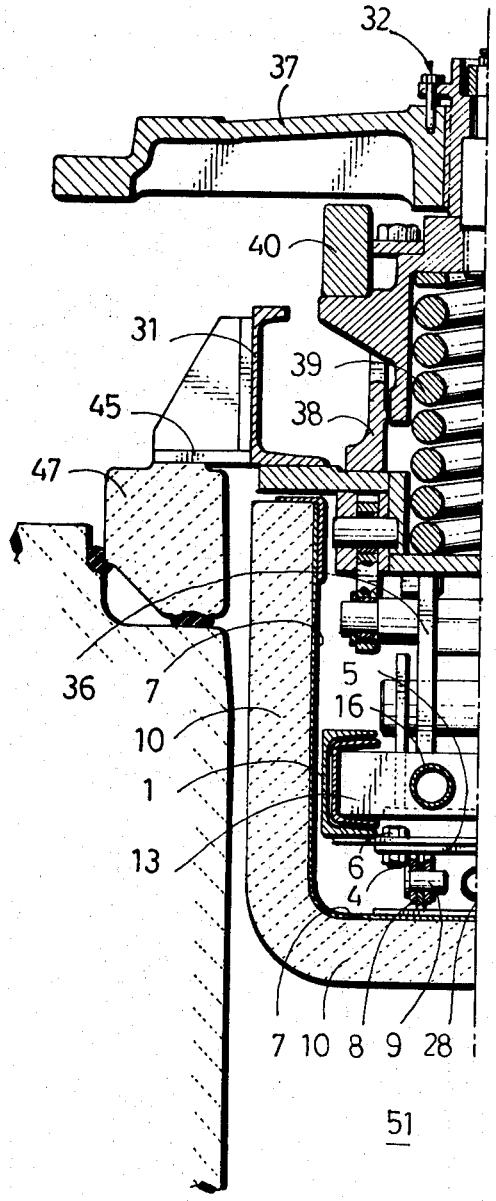
FIG. 2A is a fragmentary cross-sectional view of the heat-proof apparatus and charging unit of FIG. 1, taken along the line 2A—2A.
Figure 2B:
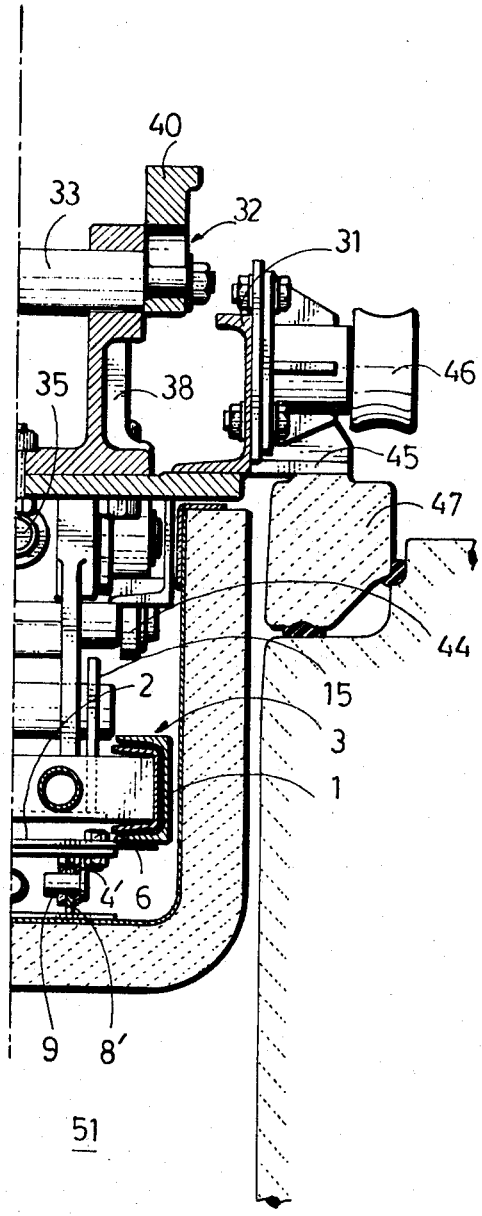
FIG. 2B is a fragmentary cross-sectional view of the heat-proof apparatus and charging unit of FIG. 1, taken along the line 2B—2B.
Figure 3:
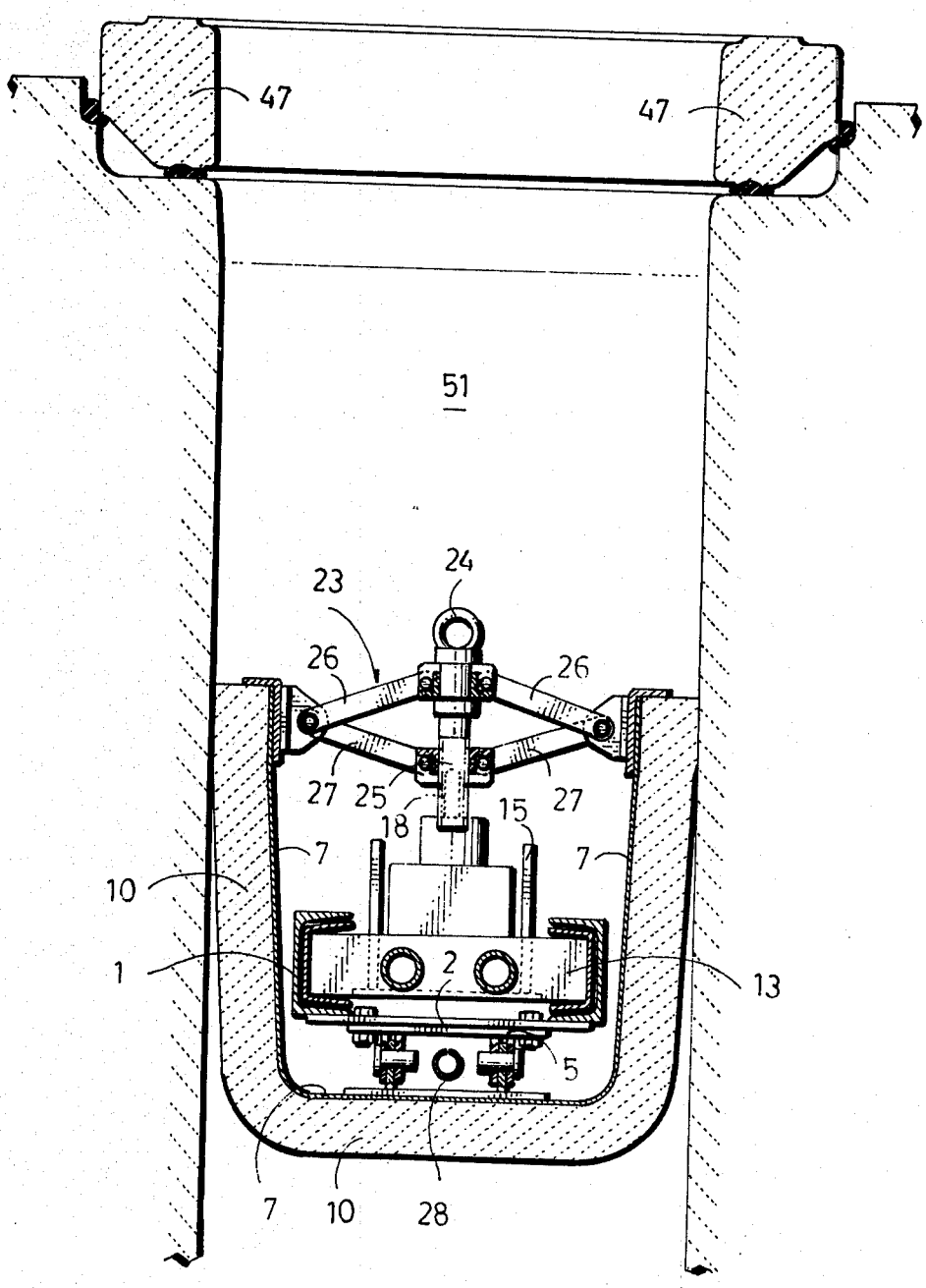
FIG. 3 is a further cross-sectional view of the heat-proof apparatus of FIG. 1 in a condition of full expansion against the walls of the oven chamber.

As shown in FIGS. 1 and 3, between both side walls of the heat-proof plate 7 and in front of the vertical frame 3, there are mounted upper and lower expander devices 23 capable of causing the adiabatic member 10 to pressure-contact both side walls of the coke oven to produce a complete seal. Each of the expander devices 23 comprises a shaft 25 having a worm-screwed portion on one end, an eye 24 on the other end and pairs of links 26 and 27 connected to the heat-proof plate 7. Both inner ends of the links 26 are pivotally connected to a bearing of the shaft 25, while the inner ends of the links 27 are pivotably connected to a female member meshing with the worm-screw portion of the shaft 25. Further, as shown in FIGS. 1, 2 and 3, an air-cooling duct 28 is arranged between the brackets 4 and 4'. The position of the air-cooling duct is not critical.

Figure 4:
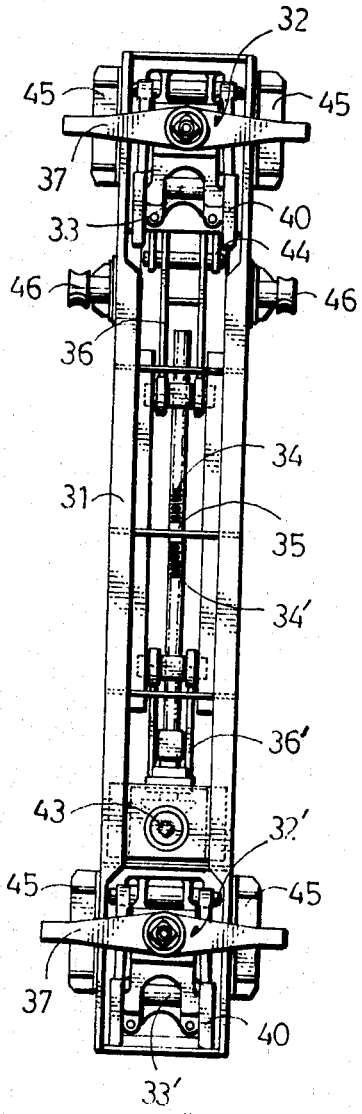
FIG. 4 is a front view of the charging unit illustrated in FIG. 1.

Now, referring to FIGS. 1, 4 and 7, there is illustrated a charging unit for the above heat-proof unit. The charging unit comprises a pair of vertical frames 31 provided with both upper and lower locking bar devices 32 and 32' and lug pieces 33 and 33'. The unit further comprises a rotatable shaft 35 with normal and reverse screw threads 34 and 34' and provided with upper and lower supporting arms 36 and 36' which are pivotably connected to female members (not identified). On the lower end of the shaft 35 is mounted a bevel gear 41 which meshes with another bevel gear 42. On the other end of a shaft 43 of the bevel gear 42 is formed a square hole for receiving a drive means (not shown) to drive the bevel gear 42. Upper and lower auxiliary arms 44 and 44' are arranged each with one end pivotably connected with the center portion of the corresponding support arm 36 or 36' and the other end pivotably connected with a bracket extending from the locking bar device 32 to guide the supporting arm. In the drawings, the following referential numerals designate respectively; 37, a locking bar; 38, a bar housing; 39, a coil spring; 40, a spring holding plate; 45, a stopper; and 46, a suspending roller.

In operation, when any specific oven gate and vicinity at a pusher- or coke-side of a coke oven chamber 51 is in need of repairs, the heat-proof apparatus of this invention which has been so far hung up in a depository is now carried together with the charging unit from the depository to the front of the coke oven chamber by a door lifter 55 per se mounted, for example, on a pusher or a coke guide car. When it has been carried to the front of the chamber and the upper and lower stopper plates 45 of the charging unit abut against a door sealing frame 47 to stop the door lifter 55, a drive means (not shown) is put into the square hole 43 of the bevel gear shaft of the charging unit to rotate the rotatable shaft 35 through the bevel gears 42 and 41. Rotation of the shaft 35 causes the upper and lower female screw members connected to the arms 36 and 36' to move up and down, respectively. This results in advancement of the front ends of the arms 36 and 36', as shown in FIG. 7, and allows the heat-proof unit to be charged deep into the coke oven chamber 51. A drive means (not shown) is then inserted into the eyes 18, 22 and 24 in order that the bevel gears 17' 17, 21' 21, the shafts 25 and the female screw members meshing with the shafts are respectively driven to actuate the upper and lower slide frames 13 and 14 and the expander devices 23. Thereby, the upper and lower adiabatic members 19 and 20 and both ends of the side walls of the adiabatic member 10 are caused to pressure contact the respective coke oven chamber walls to prevent interior hot air from blowing off the oven chamber.

Since the heat-proof unit can now stand independently in this condition as shown in FIG. 1, and both upper and lower hooks 15 and 15' are freed from the arms 36 and 36' in the process of elevating the slide frame 13, the charging unit now can be removed and returned to its original location by the door lifter 55.

The oven gate and vicinity thus separated from the hot interior air of the oven by the above-described heat-proof apparatus can be repaired under very good conditions, and if desired, the conditions can be further improved by cool air from the air-cooling duct 28. After completion of the repairs, the charging unit is again carried to the front of the coke oven chamber by the door lifter 55 and both supporting arms 36 and 36' are advanced, if necessary, by driving the bevel gears 42 and 41. The bevel gears 17' and 17 are then driven in reverse by a drive means inserted into the eye 18 until the upper adiabatic member 19 leaves the ceiling of the oven chamber and the hooks 15 and 15' engage the ends of the supporting arms 36 and 36'. After restoring the expander devices 23 and the lower adiabatic member 20 to the original condition by driving the eyes 24 and 22 respectively, the heat-proof apparatus is carried together with the charging unit from the coke oven chamber to the original place by the door lifter 55.

We claim:

1. Heat-proofing apparatus for use in repairing a coke oven gate or the vicinity thereof, which comprises:

a heat-proofing unit including;

a vertical adiabatic member of substantially "C" shaped cross-section having a rear wall and two side walls, and receivable within a coke oven chamber through a gate opening;

vertical frame means positioned within the adiabatic member and fastened thereto;

means for expanding said side walls outwardly adjacent the front ends thereof to pressure-contact the sides of a coke oven chamber; and upper and lower adiabatic members mounted to said frame means;

whereby the coke oven chamber can be substantially sealed off at a point to the rear of the gate opening during repair work in the vicinity of the opening, insulating said vicinity from the hot air within the chamber.

2. Apparatus as recited in claim 1 wherein said heat-proofing unit further includes means for advancing said upper adiabatic member toward the ceiling of the coke oven chamber and into pressure-contact therewith, and means for advancing said lower adiabatic member toward the bottom of the coke oven chamber and into pressure-contact therewith.

3. Apparatus as recited in claim 2 which further includes means for positioning said heat proofing unit into the chamber for engagement with the walls thereof while the chamber is in operation, said positioning means being detactable from said heat proofing unit after said heat proofing unit is positioned within the chamber to provide access to the vicinity of the opening.

4. Apparatus as recited in claim 3 wherein said vertical frame means includes a sliding frame carrying the upper adiabatic member and mounted for relative vertical movement between a retracted position in which the upper adiabatic member is out of contact with the ceiling of the chamber and an extended position in which the upper adiabatic member pressure-contacts the ceiling.

5. Apparatus as recited in claim 4 wherein said positioning means includes charging means engageable with said sliding frame in a supporting relationship for the sliding frame in said retracted position and disengageable from the sliding frame for the sliding frame in said extended position.

6. Apparatus as recited in claim 5 wherein said charging means comprises a vertical main frame; a shaft mounted for rotation relative to the main frame and having first and second oppositely threaded portions thereon; upper and lower female screw members engaged with said oppositely threaded portions, respectively, and actuable therealong by rotation of said shaft; upper and lower supporting arms, each having one end pivotably connected to the corresponding screw member and the other end engageable with said sliding frame in a supporting relationship for the sliding frame in said retracted position; upper and lower auxiliary arms, each having one end pivotably connected to the main frame and the other end pivotably connected to one of the supporting arms between the two ends thereof; and means for rotatably driving the shaft; whereby rotation of the shaft operates through the supporting arms to advance said heat proofing unit into the chamber or withdraw it therefrom.

7. Apparatus as recited in claim 6 wherein said means for rotatably driving the shaft comprises a first bevel gear carried by the lower end of the shaft and a second bevel gear carried by a second shaft and meshing with the first bevel gear, said second shaft forming a square connector hole at one end.

8. Apparatus as recited in claim 4 wherein said means for advancing the upper adiabatic member includes screw means having a vertical threaded rod mounted to said sliding frame and engaging a female screw element for actuating the sliding frame between said retracted and extended positions.

9. Apparatus as recited in claim 8 wherein said female screw element of said upper advancing means comprises an axially threaded bevel gear and the upper advancing means further comprises a bevel drive gear engageable with said threaded gear and provided with an eye extending therefrom.

10. Apparatus as recited in claim 4 wherein said vertical frame means includes a second sliding frame carrying the lower adiabatic member and mounted for relative vertical movement between a retracted position in which the lower adiabatic member is out of contact with the bottom of the chamber and an extended position in which the lower adiabatic member pressure-contacts the bottom.

11. Apparatus as recited in claim 10 wherein said means for advancing the lower adiabatic member includes screws means having a vertical threaded rod mounted to said second sliding frame and engaging a female screw element for actuating the second sliding frame between said retracted and extended positions.

12. Apparatus as recited in claim 11 wherein the female screw element of said lower advancing means comprises an axially threaded bevel gear and the lower advancing means further comprises a bevel drive gear engageable with said threaded gear and provided with an eye extending therefrom.

13. Apparatus as recited in claim 2 wherein said expanding means comprises a threaded expander shaft and first and second pairs of link elements having outer ends pivotably connected to said side walls of said vertical adiabatic member, the inner ends of said first pair of link elements being pivotably connected to a bearing at a point on the expander shaft and the inner ends of said second pair of link elements being pivotably connected to a female member threaded onto the expander shaft; such that said side walls can be expanded outwardly by rotation of said expander shaft.

14. Apparatus recited in claim 2 which includes an air-cooling duct located between said two side walls of said vertical adiabatic member for introducing cooling air to the area.

* * * * *